US005332114A

United States Patent [19]

Sano et al.

[11] Patent Number: 5,332,114

[45] Date of Patent: Jul. 26, 1994

[54] CONTAINER

[75] Inventors: Yasumasa Sano; Takao Ohsugi, both of Fuji, Japan

[73] Assignee: Jatco Corporation, Fuji, Japan

[21] Appl. No.: 31,365

[22] Filed: Mar. 15, 1993

[30] Foreign Application Priority Data

Mar. 17, 1992 [JP] Japan ..... 4-060659

[51] Int. Cl.[5] ..... B65D 6/02

[52] U.S. Cl. ..... 220/4.24; 206/505; 206/508; 206/511; 220/4.27

[58] Field of Search ..... 220/4.24, 4.27; 206/505, 508, 511

[56] References Cited

U.S. PATENT DOCUMENTS 3,407,961 10/1968 Box ..... 220/4.24
3,754,676 8/1973 Box ..... 220/4.24
4,925,045 5/1990 Logsdon ..... 220/4.24
5,042,674 8/1991 Ramsay et al. ..... 220/4.24

*Primary Examiner*—Joseph Man-Fu Moy
*Attorney, Agent, or Firm*—Foley & Lardner

[57] ABSTRACT

A container for containing automatic transmissions or the like comprises first and second cases which are identical in shape. A first group of coupling portions are possessed by each case, which establish a coupling of the first and second cases when the first and second cases are mated in a front-to-front mating manner. A second group of coupling portions are possessed by each case, which establish a coupling of the first and second cases when the first and second cases are mated in a back-to-back mating manner. A third group of coupling portions are possessed by each case, which establish a coupling of the first and second cases when the first and second cases are mated in a front-to-back mating manner.

18 Claims, 10 Drawing Sheets

CONTAINER

BACKGROUND OF THE INVENTION

1. Field of the Invention

The present invention relates in general to containers, and more particularly to containers of a type including upper and lower cases which can define an enclosed containing space when coupled.

2. Description Of The Prior Art

In the automotive field, various containers have been used for containing automotive parts. Usually, the containers are of a type which comprises upper and lower cases which are different in shape. However, using different upper and lower cases causes a difficulty or troublesomehess with which they have to be produced and managed.

SUMMARY OF THE INVENTION

Accordingly, an object of the present invention to provide a container which is free of the above-mentioned drawback. That is, the container of the present invention comprises two cases which are identical in shape.

According to a first aspect of the present invention, there is provided a container comprising first and second cases which are identical in shape; a first group of coupling portions possessed by each case, the first group of coupling portions establishing a coupling of the first and second cases when the first and second cases are mated in a front-to-front mating manner; a second group of coupling portions possessed by each case, the second group of coupling portions establishing a coupling of the first and second cases when the first and second cases are mated in a back-to-back mating manner; and a third group of coupling portions possessed by each case, the third group of coupling portions establishing a coupling of the first and second cases when the first and second cases are mated in a front-to-back mating manner.

According to a second aspect of the present invention, there is provided a transmission container which comprises first and second cases which are identical in shape, each case including four side walls and one generally rectangular bottom wall which are united to constitute a receptacle; raised and recessed structures alternately formed on a front edge of each case, the raised and recessed structures of one case being engaged with the recessed and raised structures of the other case when the two cases are mated in a front-to-front manner; means defining holes in the front edge of each case; studs formed on the front edge of each case, the studs of one case being received in the holes of the other case when the two cases are mated in the front-to-front manner; a plurality of coupling structures formed on given areas of an outer surface of the bottom wall of each case, the coupling structures of one case being engaged with the coupling structures of the other case when the two cases are mated in a back-to-back manner; a plurality of external projections possessed by each case and positioned outside of the case, the external projections of one case being put on a front edge of the other case when the two cases are mated in a front-to-back manner; a first group of internal projections possessed by each case and positioned inside of the case, the first group of internal projections of one case supporting thereon the outer surface of the bottom wall of the other case when the two cases are mated in the front-to-back manner; and a second group of internal projections which are possessed by each case, positioned inside of the case and formed hollow, the second group of internal projections of one case being partially received in the hollows of the second group of internal projections of the other case when the two cases are mated in the front-to-back manner.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, a container of the present invention will be described with reference to the accompanying drawings.

The container comprises two identical cases which can define an enclosed space when coupled normally, that is, in a front-to-front mating manner. Thus, each case can be referred to as upper or lower case.

Figure 1:
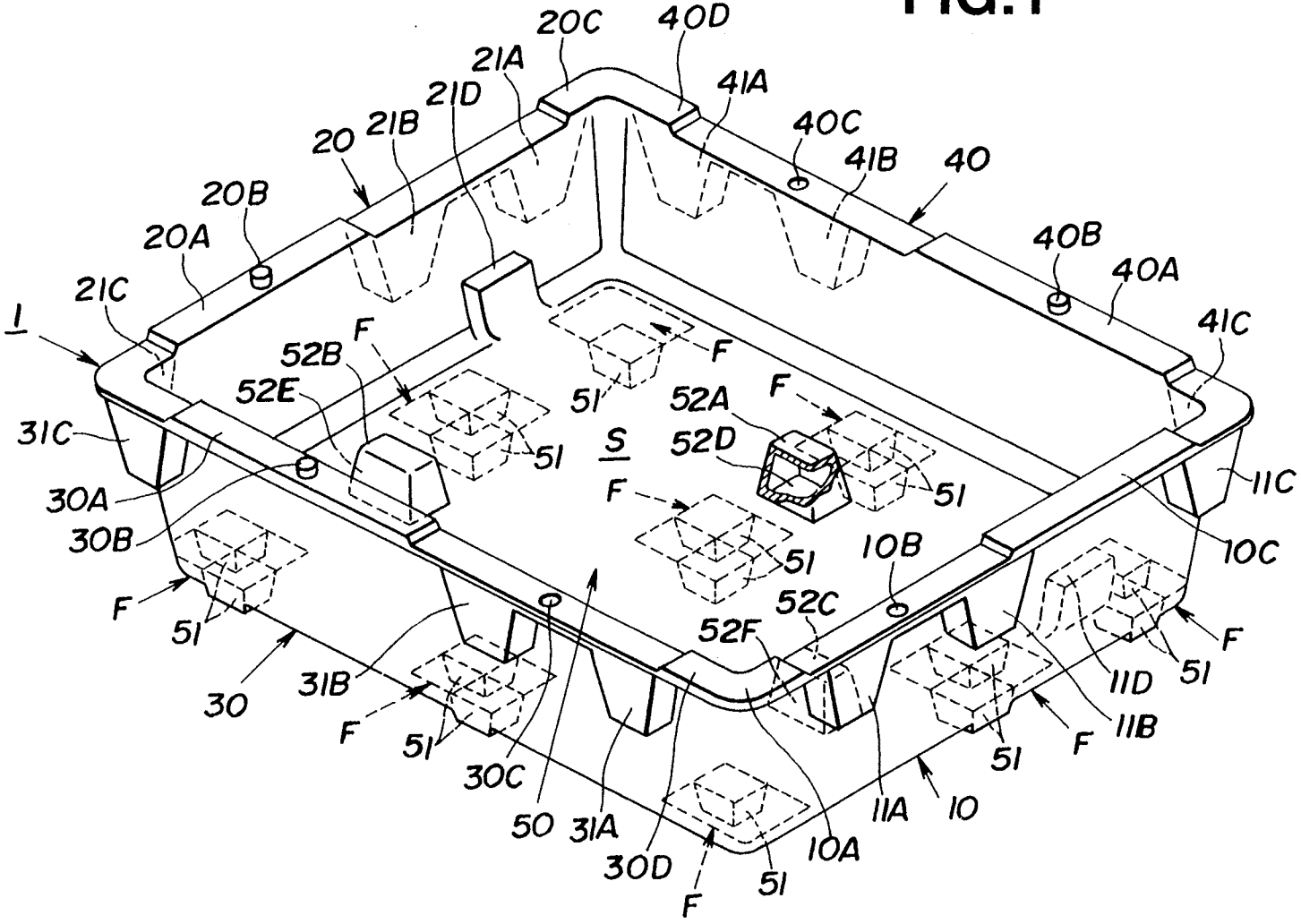
FIG. 1 is a perspective view of one case of a container, which embodies the present invention.

Referring to FIG. 1, there is shown one of the identical cases, which is generally denoted by numeral 1. The case 1 comprises a generally rectangular bottom wall 50, first and second shorter side walls 10 and 20 raised from shorter opposed edges of the bottom wall 50, and third and fourth longer side walls 30 and 40 raised from longer opposed edges of the bottom wall 50.

As will become apparent as the description proceeds, the case 1 is formed with first, second and third groups of coupling portions, which are used for coupling the case 1 with the other case 1 in various (namely, three) fashions.

The first group of coupling portions will be described in detail with reference to FIG. 2.

As will be understood from this drawing, the first group of coupling portions are designed to couple the two cases 1 (viz., lower and upper cases 1-A and 1-B) in a so-called "front-to-front" mating manner. In other words, when flanged front edges of the first, second, third and fourth side walls 10, 20, 30 and 40 of the lower case 1-A and the flanged front edges of the second, first, third and fourth side walls 20, 10, 30 and 40 of the upper case 1-B are mated, the two cases 1-A and 1-B become coupled by the first group of coupling portions to constitute the container. It is to be noted that the orientation of the upper case 1-B as illustrated in FIG. 2 becomes matched with that of the lower case 1-A when the latter is turned about the axis $o_1$ by 180 degrees.

The first group of coupling portions comprise raised and recessed structures formed on the flanged front edges of the case 1, which will be understood from the following description.

That is, the flanged front edge of the first side wall 10 is formed with a first raised portion 10A, a second raised portion 10C and a hole 10B positioned between the first and second raised portions 10A and 10C, and the flanged front edge of the second side wall 20 is formed with a first raised portion 20A, a second raised portion 20C and a stud 20B formed on the first raised portion 20A.

Figure 2:
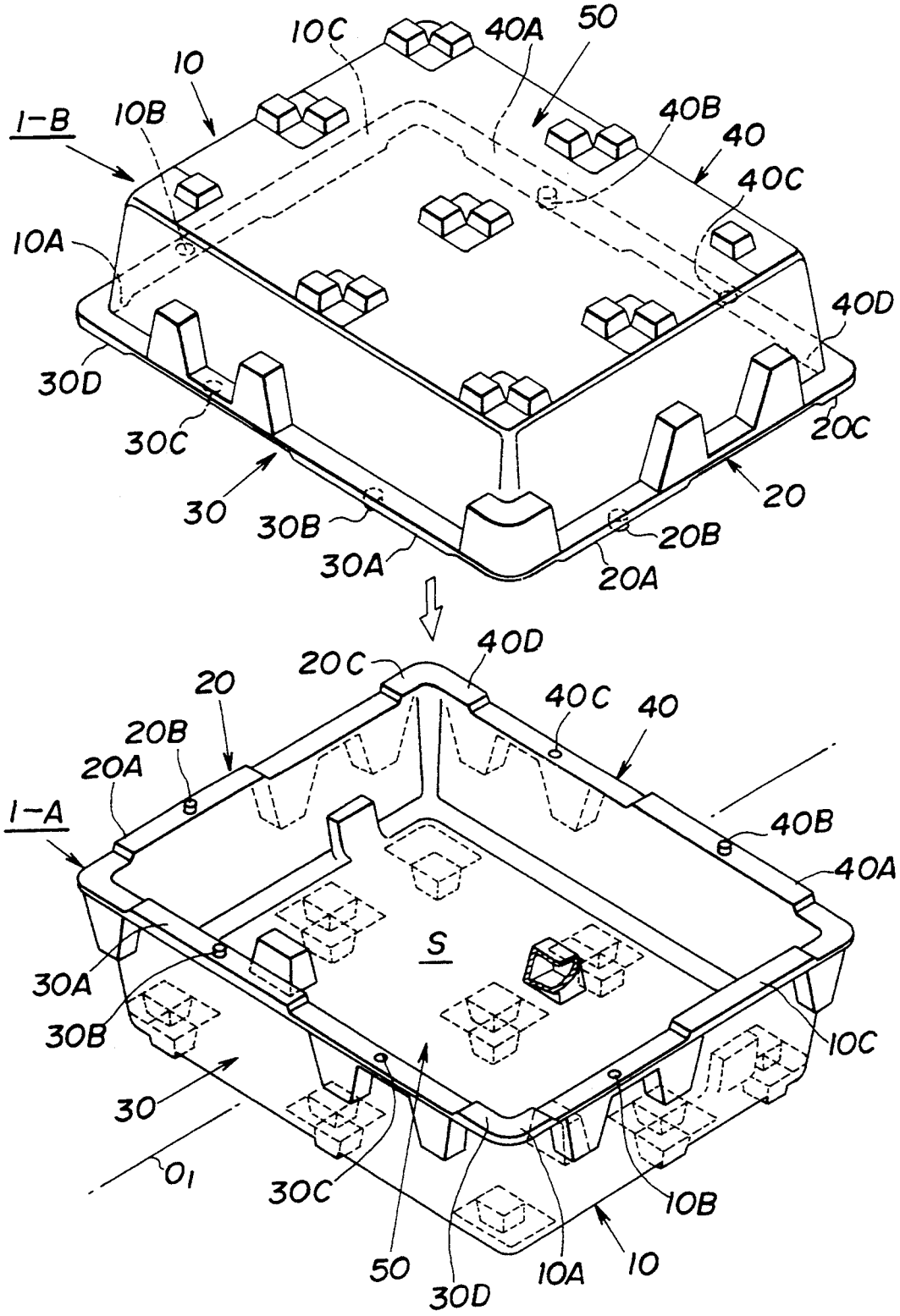
FIG. 2 is a perspective view of two cases, showing a condition wherein they are going to couple in a so-called "front-to-front" mating manner.

Thus, when, as is seen from FIG. 2, the lower and upper cases 1-A and 1-B are mated at their flanged front edges, the following two engagements take place at both shorter sides of the coupled cases.

That is, at the left side as viewed in FIG. 2, the first raised portion 20A of the lower case 1-A is put between the first and second raised portions 10A and 10C of the upper case 1-B, and the second raised portion 10C of the upper case 1-B is put between the first and second raised portions 20A and 20C of the lower case 1-A, and at the same time, the stud 20B of the lower case 1-A is put into the hole 10B of the upper case 1-B. Further, at the right side, the first raised portion 20A of the upper case 1-B is put between the first and second raised portions 10A and 10C of the lower case 1-A, and the second raised portion 10C of the lower case 1-A is put between the first and second raised portions 20A and 20C of the upper case 1-B, and at the same time, the stud 20B of the upper case 1-B is put into the hole 10B of the lower case 1-A.

The flanged front edge of the third side wall 30 is formed with a first raised portion 30A, a second raised portion 30D, a stud 30B formed on the first raised portion 30A and a hole 30C positioned between the first and second raised portions 30A and 30D, and the flanged front edge of the fourth side wall 40 is formed with a first raised portion 40A, a second raised portion 40D, a stud 40B formed on the first raised portion 40A, and a hole 40C positioned between the first and second raised portions 40A and 40D.

It is to be noted that the raised portions 10A and 30D are integrated to form a single raised portion, and the raised portions 20C and 40D are integrated to form a single raised portion.

When, as is seen from FIG. 2, the lower and upper cases 1-A and 1-B are mated at their flanged front edges, the following two engagements take place at respective longer sides (viz., this and back sides as viewed in FIG. 2) of the coupled cases.

That is, at this side in the drawing, the first raised portion 30A of the lower case 1-A is put between the first and second raised portions 30A and 30D of the upper case 1-B, and the first raised portion 30A of the upper case 1-B is put between the first and second raised portions 30A and 30B of the lower case 1-A, and at the same time, the stud 30B of the lower case 1-A is put into the hole 30C of the upper case 1-B and the stud 30B of the upper case 1-B is put into the hole 30C of the lower case 1-A. Further, at the back side, the first raised portion 40A of the lower case 1-A is put between the first and second raised portions 40A and 40D of the upper case 1-B, and the first raised portion 40A of the upper case 1-B is put between the first and second raised portions 40A and 40D of the lower case 1-A, and at the same time, the stud 40B of the lower case 1-A is put into the hole 40C of the upper case 1-B and the stud 40B of the upper case 1-B is put into the hole 40C of the lower case 1-A. With this, the upper case 1-B is stably put on the flanged front edge of the lower case 1-A.

In the following, the second group of coupling portions will be described in detail with reference to FIG. 3.

As will be understood from this drawing, the second group of coupling portions are designed to couple the two cases 1 (viz., lower and upper cases 1-A and 1-B) in a so-called "back-to-back" mating manner. That is, the second group of coupling portions establish the coupling of the two identical cases 1-A and 1-B when the cases are mated in a back-to-back manner. It is to be noted that the orientation of the upper case 1-B as illustrated in FIG. 3 becomes matched with the that of the lower case 1-A when the latter is turned about the axis $o_2$ by 180 degrees.

Figure 3:
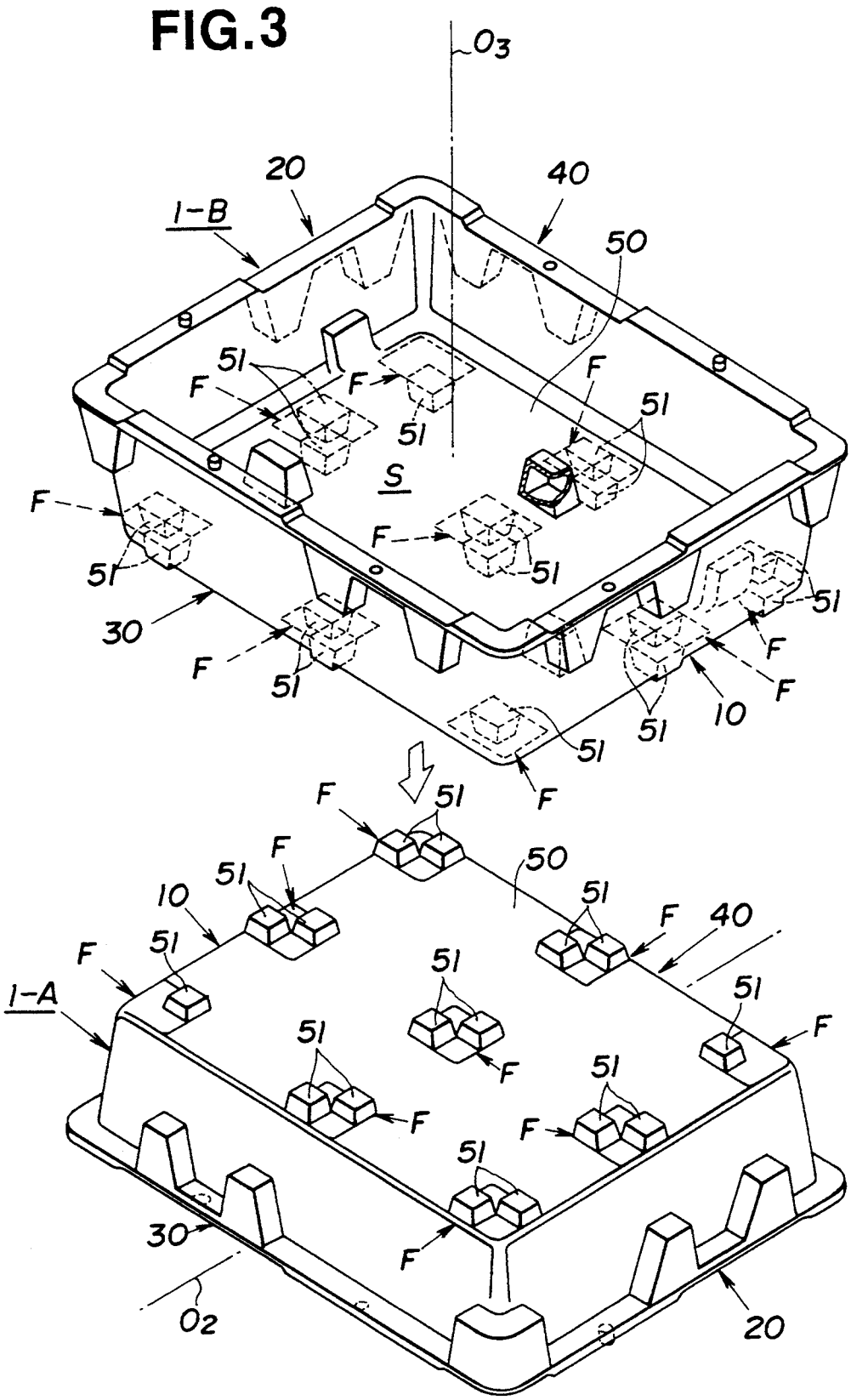
FIG. 3 is a perspective view of the two cases, showing a condition wherein they are going to couple in a so-called "back-to-back" mating manner.

As is seen from FIG. 3, the second group of coupling portions comprise nine coupling structures which are respectively formed on nine square areas "F" on an outer surface of the rectangular bottom wall 50. As shown, these square areas "F" are laid out at right angles. Seven of the nine coupling structures are of two projection type having two rectangular projections 51, and remaining two of them are of one projection type having only one rectangular projection 51. The two coupling structures of one projection type are positioned at diagonally opposed corners of the bottom wall 50. As shown, in the two projection type, the two projections 51 are diagonally positioned in the square area "F", while in the one projection type, the projection 51 is positioned at the inside corner of the square area "F" It is to be noted that due to provision of the projections 51, corresponding gaps (no numerals) are defined by them, which will be referred to as mating gaps hereinafter.

Thus, as is seen from FIG. 3, when the lower and upper cases 1-A and 1-B are mated at their backs, the projections 51 of the lower case 1-A are all put into the mating gaps which are defined by the projections 51 of the upper case 1-B. With this, the upper case 1-B is stably put on the back of the lower case 1-A.

It is to noted that even if the upper case 1-B is turned about the axis $O_3$ by 180 degrees from the position illustrated, the engagement between the projections 51 and the mating gaps is obtained.

In the following, the third group of coupling portions will be described in detail with reference to FIG. 4.

As will be understood from this drawing, the third group of coupling portions are designed to couple the two cases 1-A and 1-B in a so-called "front-to-back" mating manner. That is, the third group of coupling portions establish the coupling of the two identical cases 1-A and 1-B when the upper case 1-B is neatly put or received in the lower case 1-A. Thus, the case 1 (viz., 1-A or 1-B) has a trapezoidal cross section for achieving the front-to-back coupling between two cases.

Figure 4:
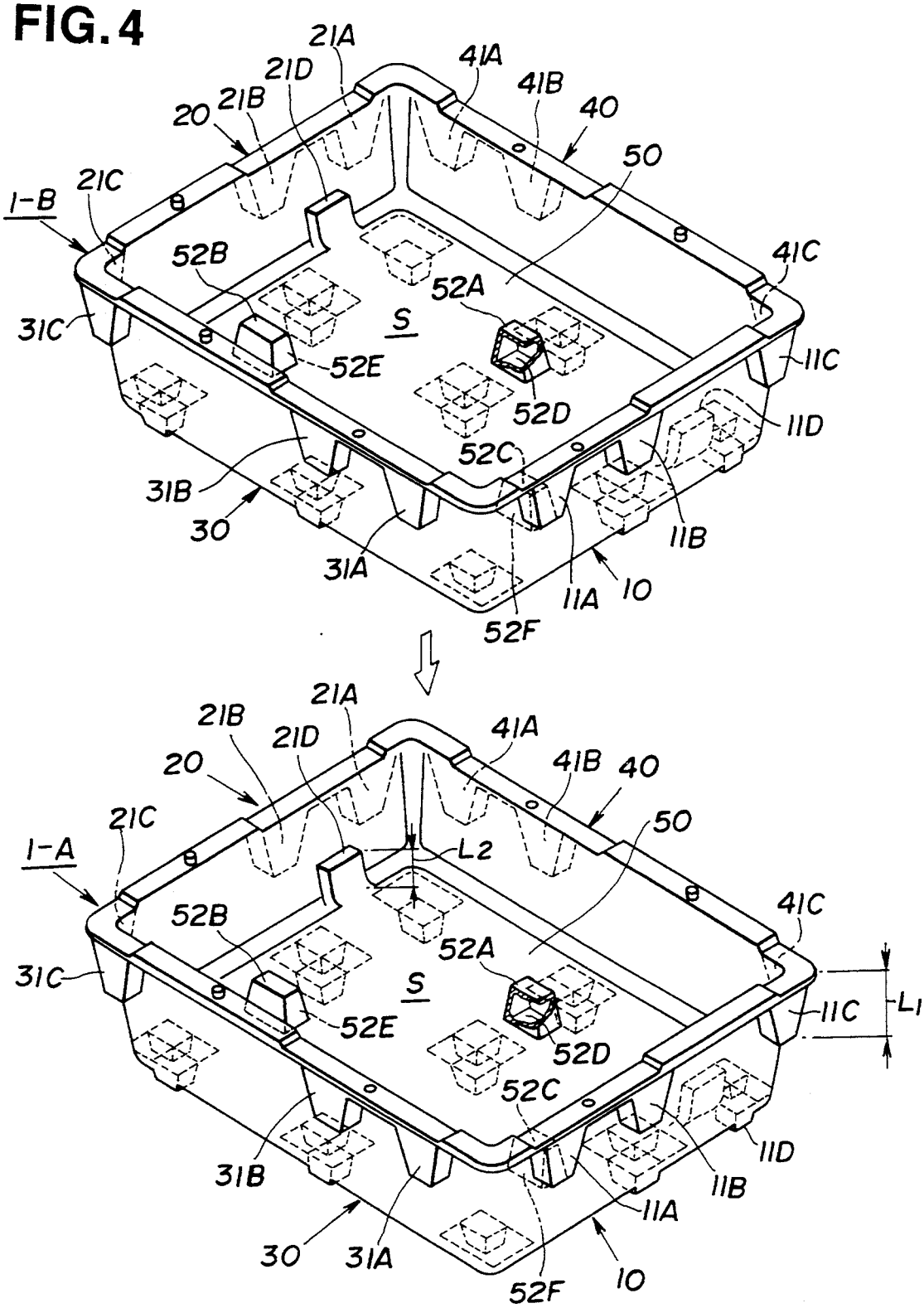
FIG. 4 is a perspective view of the two cases, showing a condition wherein they are going to couple in a so-called "front-to-back" mating manner.

As is seen from FIG. 4, the third group of coupling portions comprise a plurality of external projections 11A, 11B, 11C, 21A, 21B, 21C, 31A, 31B, 31C, 41A, 41B and 41C and a plurality of internal projections 11D, 21D, 52A, 52B and 52C, which will be understood from the following description.

That is, as is seen from the drawing, the flanged front edge of the first side wall 10 is formed with three downwardly extending tongue portions (viz., external projections) 11A, 11B and 11C, and the flanged front edge of the second side wall 20 is formed with three downwardly extending tongue portions (viz., external projections) 21A, 21B and 21C. Similar to this, the flanged front edge of the third side wall 30 is formed with three downwardly extending tongue portions (viz., external projections) 31A, 31B and 31C and the flanged front edge of the fourth side wall 40 is formed with three downwardly extending tongue portions (viz., external projections) 41A, 41B and 41C. The length of each tongue portion is designated by "$L_1$".

It is to be noted that the tongue portions 11C and 41C are integrated to form a single tongue portion, and the tongue portions 21C and 31C are integrated to form a single tongue portion.

Five projections (viz., internal projections) 11D, 21D, 52A, 52B and 52C are formed on the bottom wall 50 of the case 1. Two 11D and 21D of them are positioned near the first and second side walls 10 and 20 respectively, while the other three projections 52A, 52B and 62C are positioned away from the side walls 10, 20, 30 and 40, as shown. It is to be noted that these three projections 52A, 52B and 52C have formed therein hollows, which are designated by numerals 52D, 52E and 52F respectively. These three projections have each a trapezoidal cross section, so that when the lower case 1-A receives therein the upper case 1-B, upper portions of the three projections 52A, 52B and 52C of the lower case 1-A are received in the hollows 52D, 52E and 52F of the corresponding three projections 52A, 52B and 52C of the upper case 1-B.

Thus, when, as is seen from FIG. 4, the lower case 1-A receives the upper case 1-B, the flanged front edges of the first, second, third and fourth walls 10, 20, 30 and 40 of the lower case 1-A bear or support the external projections 11A, 11B, 11C, 21A, 21B, 21C, 31A, 31B, 31C, 41A, 41B and 41C of the upper case 1-B, and the two internal projections 11D and 21D of the lower case 1-A bear or support the bottom wall 50 of the upper case 1-B, and at the same time, the other three internal projections 52A, 52B and 52C of the lower case 1-A are partially received in the hollows 52D, 52E and 52F of the upper case 1-B. With this, the upper case 1-B is stably received in the lower case 1-A.

In the following, a transmission container to which the present invention is practically applied will be described with reference to FIGS. 5, 6, 7, 8, 9 and 10. That is, the transmission container is designed to contain three automotive automatic transmissions.

For ease of description, substantially the same parts and constructions as those of the above-mentioned container of FIGS. 1 to 4 will be omitted from following description, and they are designated by the same numerals in the drawings.

Figure 9:
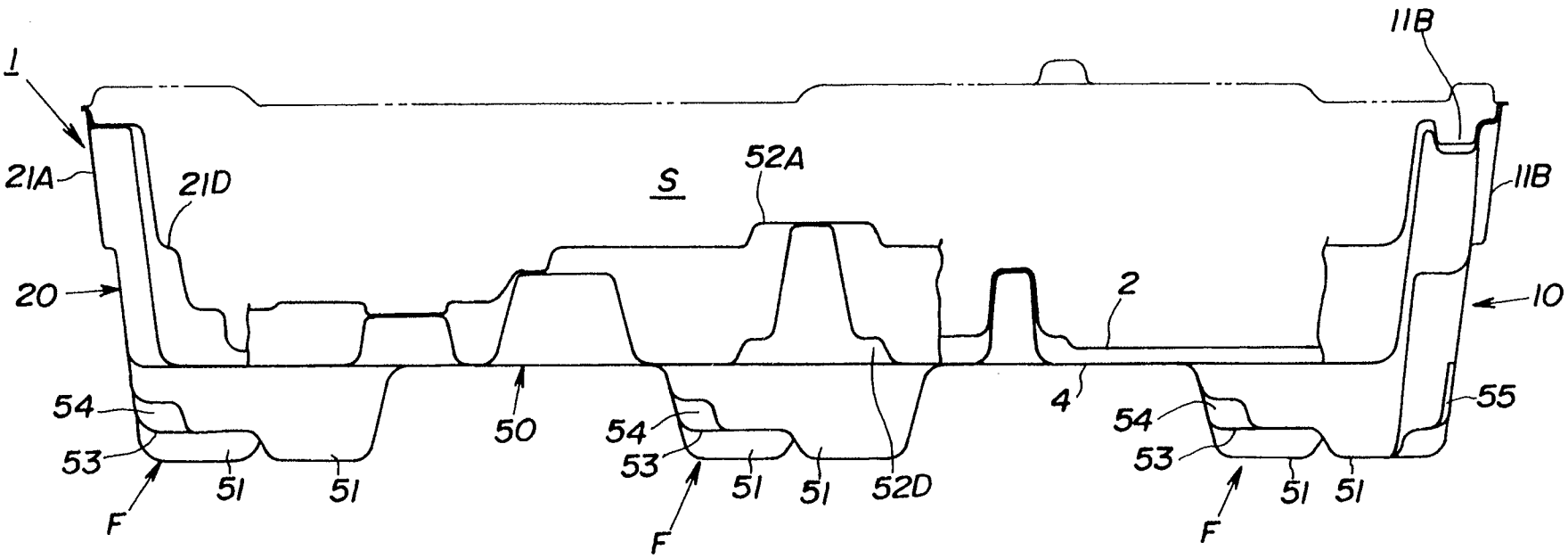
FIG. 9 is a sectional view of one case for the transmission container.
Figure 10:
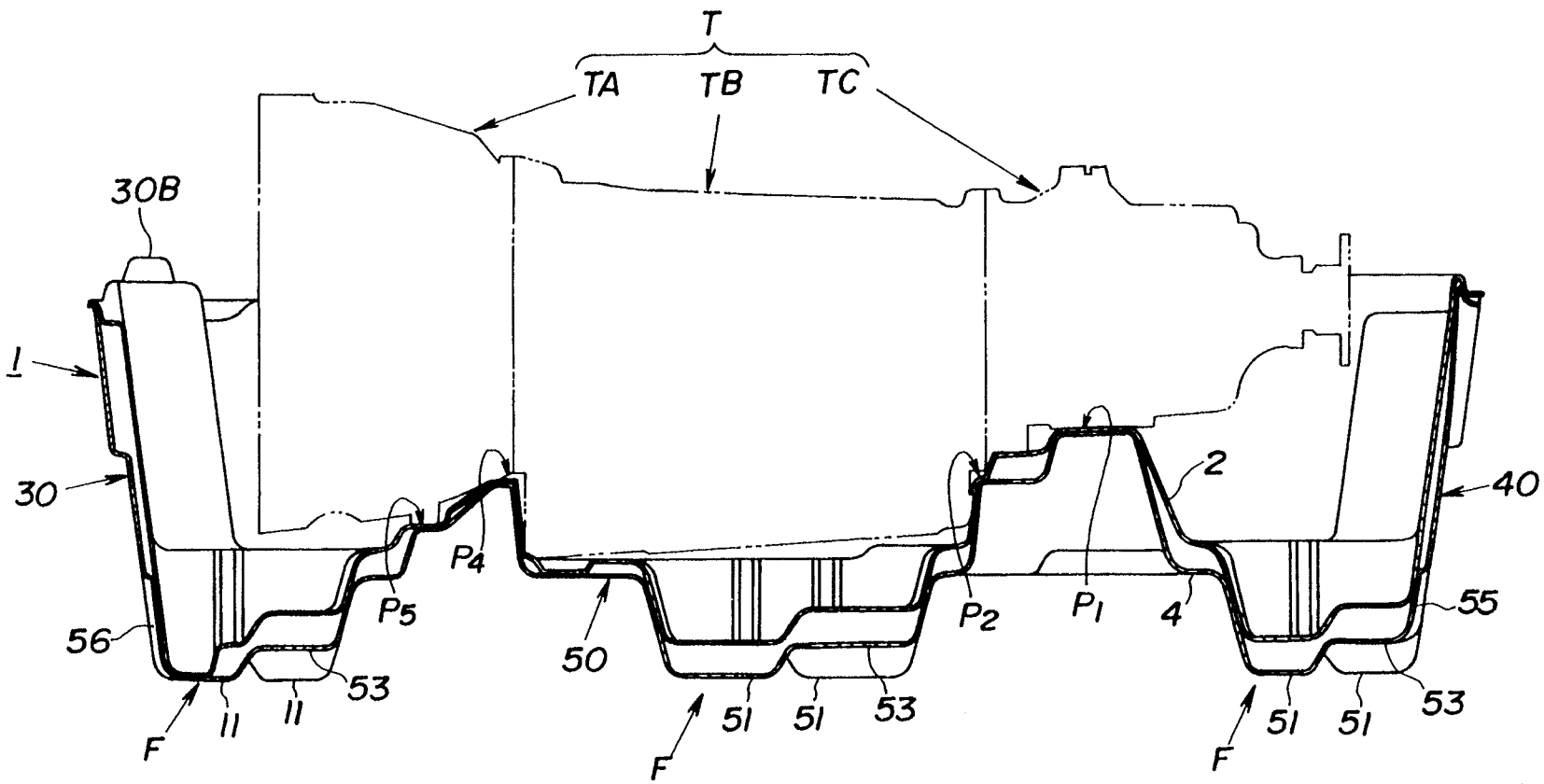
FIG. 10 is a sectional view of one case for the transmission container, with transmissions contained therein.

As will be seen from FIGS. 9 and 10, the case 1 for the transmission container is of a two-layer structure, which generally comprises an inner structural member 2 and an outer structural member 4 which are partially welded to each other to define a certain space therebetween. Because of provision of such space, the weight of the case 1 can be reduced without sacrificing the mechanical strength of the same.

Figure 5:
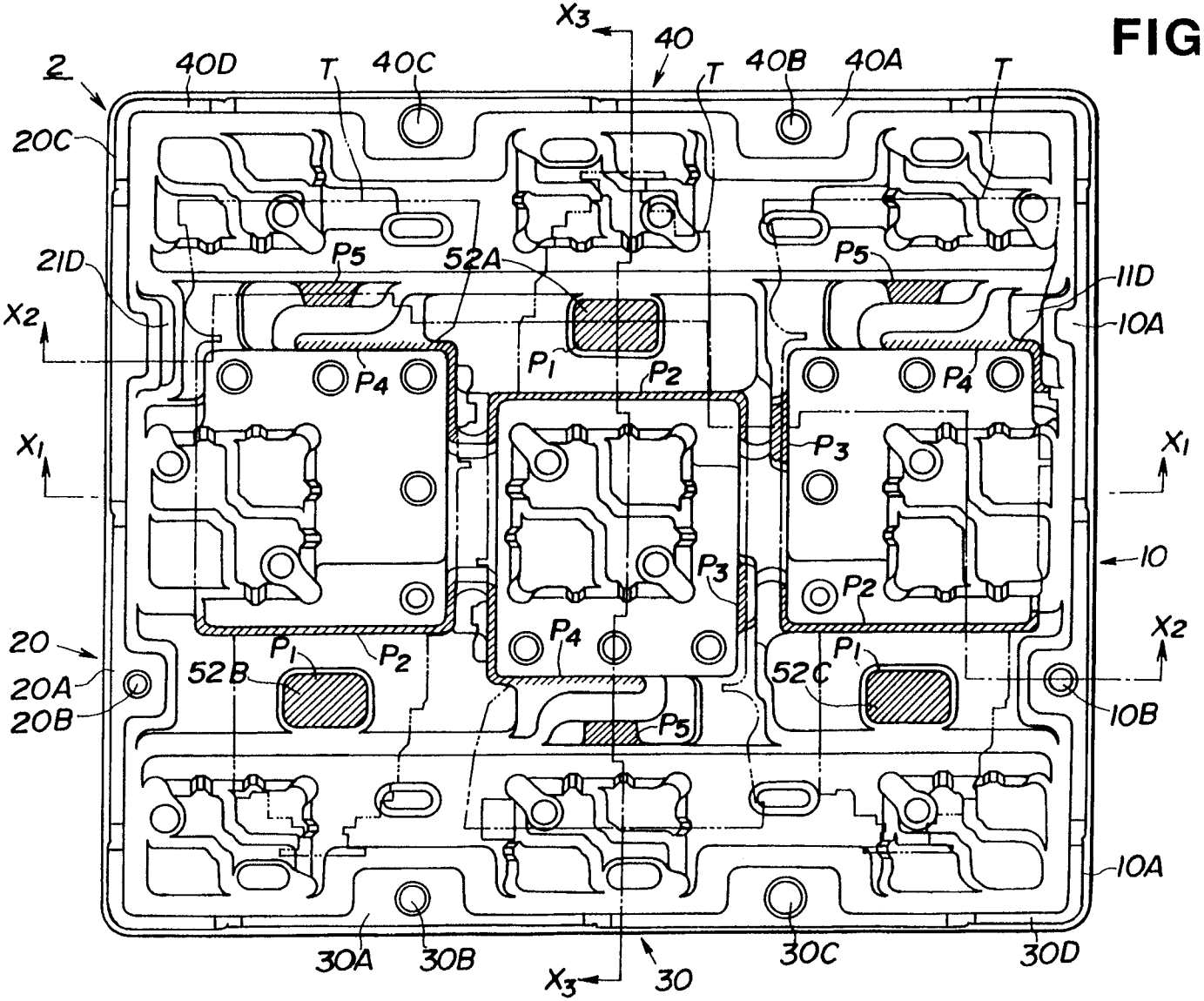
FIG. 5 is a plan view of an inner structural member which constitutes an inner layer of a transmission container which is of a two-layer structure.
Figure 6:
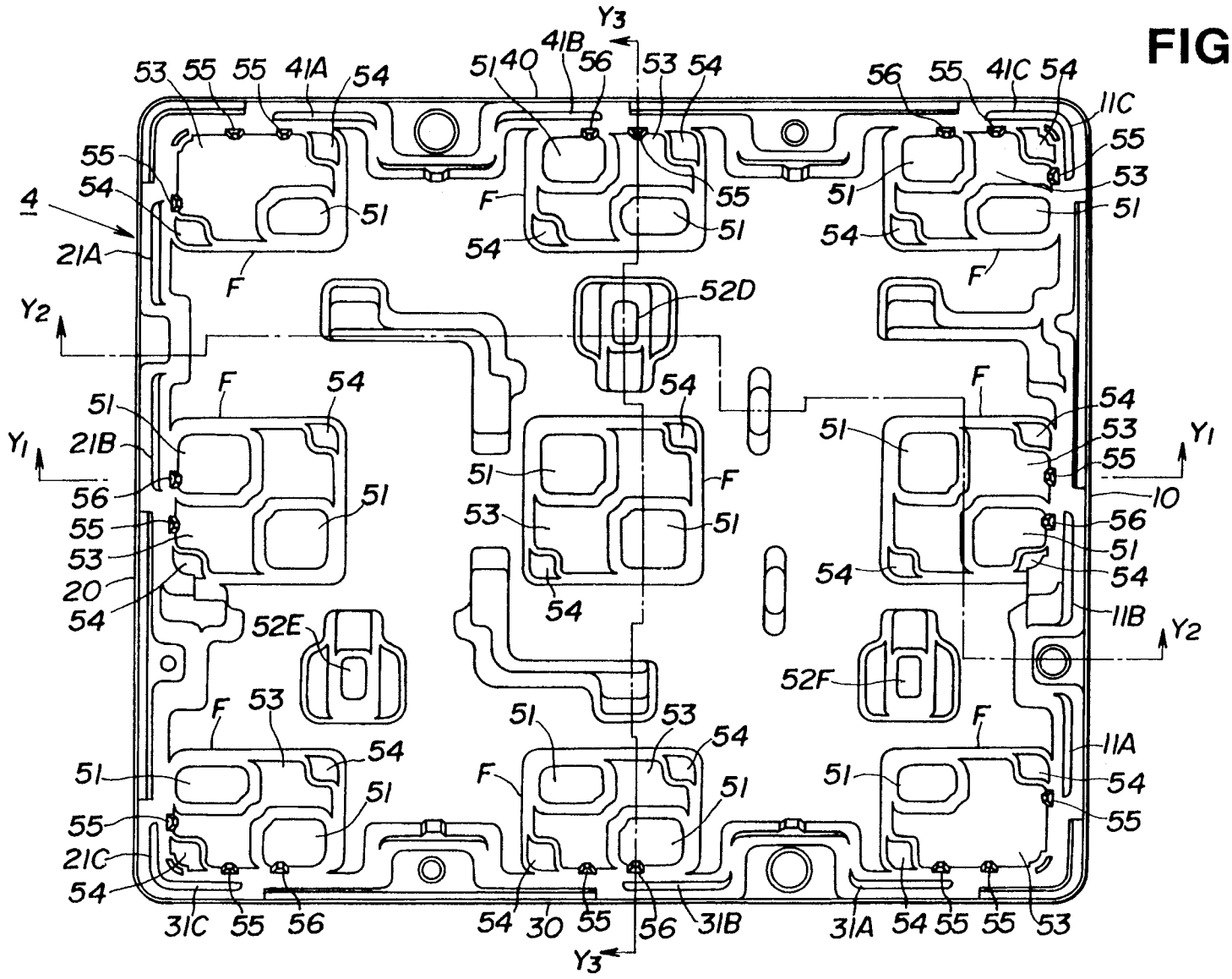
FIG. 6 is a plan view of an outer layer of the transmission container.

FIG. 5 shows a plan view of the inner structural member 2, and FIG. 6 shows a plan view of the outer structural member 4. As will be understood hereinafter, the inner structural member 2 is shaped to stably hold the automatic transmissions, and the outer structural member 4 is shaped to be easily handled.

The case 1 is formed with three groups of coupling portions which correspond to the above-mentioned first, second and third groups of coupling portions for the same purpose. The coupling portions are denoted by the same numerals in the drawings.

Figure 7:
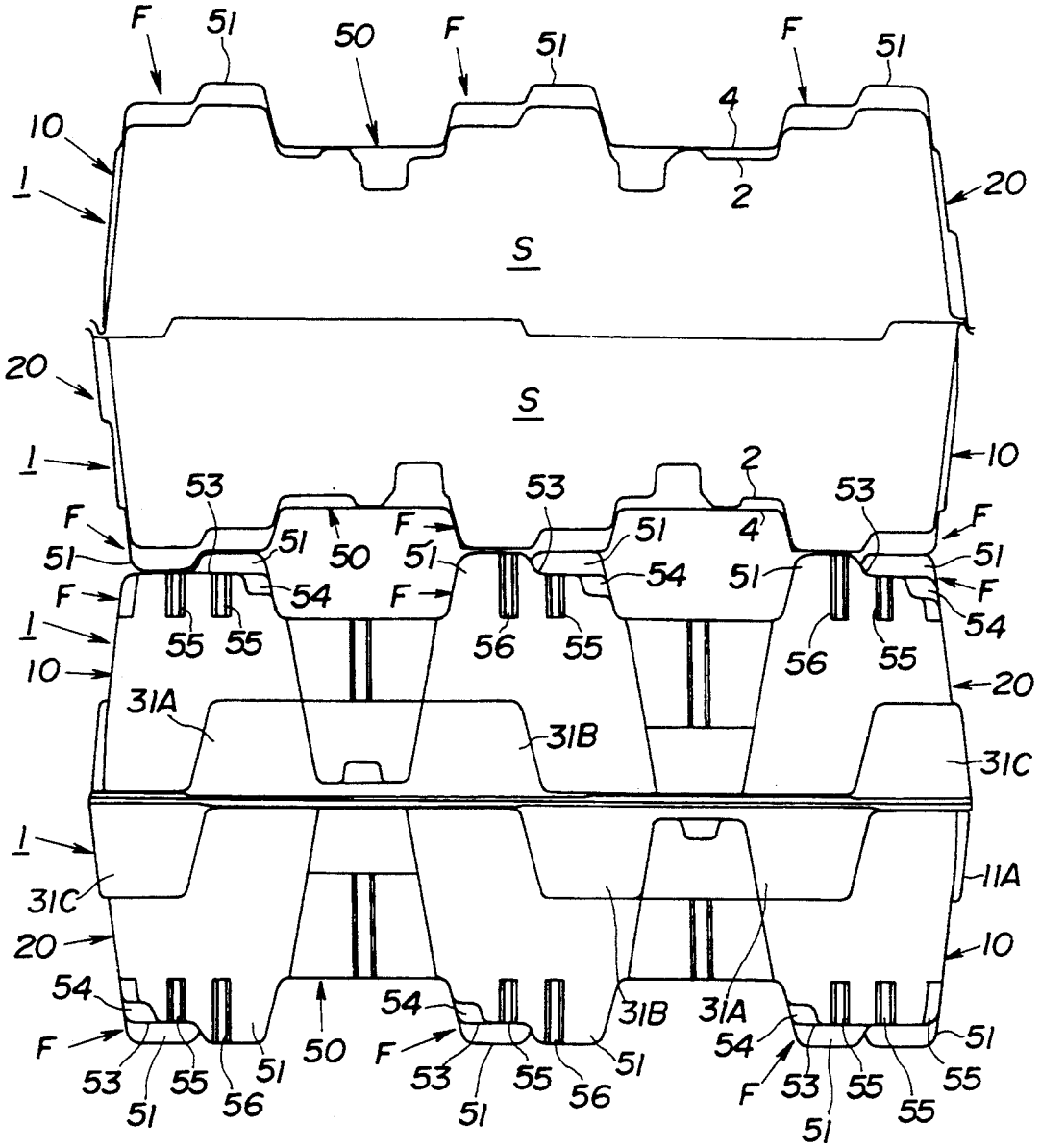
FIG. 7 is a partially cut side view of two piled transmission containers, each container including two (viz., lower and upper) identical cases coupled in the front-to-front mating manner.

Furthermore, as is seen from FIGS. 6 and 7, the nine square areas "F" are protruded outward from the bottom wall 50 (viz., the outer structural member 4). Tops of the nine protruded portions are designated by numeral 53. Each square area "F" has two rectangular projections 51 or one rectangular projection 51. Each protruded portion 53 has rounded corners 54. A side wall portion of each protruded portion 53 and a side wall portion of each projection 51 are formed with respective grooves 55 and 56. Due to provision of the rounded corners 54 and the grooves 55 and 56, the coupling of two cases 1 in the front-to-back mating manner is facilitated- Furthermore, due to the complicated form, the coupling portions of the case 1 are reinforced.

FIG. 7 is a partially cut side view showing a condition in which one (or upper) transmission container is put on another (or lower) transmission container. Each container has two cases 1 coupled in the front-to-front mating manner. The sectional view of the upper transmission container is taken along the line $X_1$—$X_1$ of FIG. 5.

Figure 8:
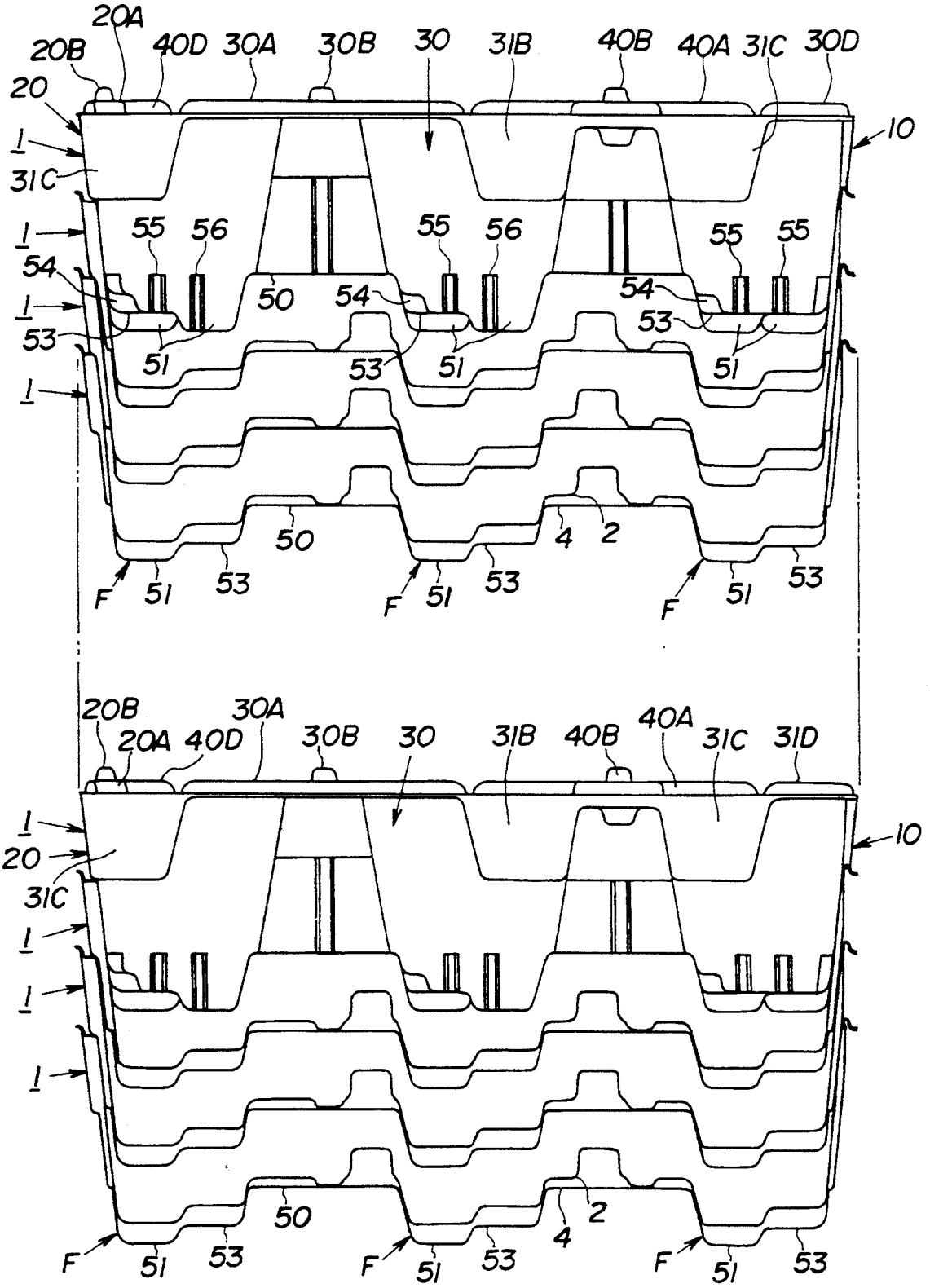
FIG. 8 is a partially cut side view of a plurality of identical cases for the transmission container, which are stacked up in the back-to-front mating manner.

FIG. 8 is a partially cut side view showing a condition in which a plurality of cases 1 are stacked up in the back-to-front mating manner. The sectional view of the stacked cases 1 other than the uppermost case and the fourth case from the lowermost case is taken along the line $X_1$—$X_1$ of FIG. 5 or the line $Y_1$—$Y_1$ of FIG. 6.

FIG. 9 is a sectional view of one case 1, which is taken along the line $X_2$—$X_2$ of FIG. 5 or the line $Y_2$—$Y_2$ of FIG. 6.

FIG. 10 is a sectional view of one case 1 with three transmissions "T" contained therein, which view is taken along the line $X_3$—$X_3$ of FIG. 5 or the line $Y_3$—$Y_3$ of FIG. 6.

As will be understood from FIG. 5, the case 1 is designed to contain therein three automotive automatic transmissions "T". The three transmissions "T" are arranged in parallel but alternately. Two of the three transmissions "T" are supported by five portions $P_1$, $P_2$, $P_3$, P4 and P5 of each containing part of the case 1, which portions are hatched in the drawing. These portions $P_1$, $P_2$, $P_3$, $P_4$ and $P_5$ have a larger rectangular supporting surface, a generally U-shaped supporting surface, a thinner rectangular supporting surface, a generally L-shaped supporting surface and a smaller rectangular supporting surface. While, the remaining one (viz., left transmission in FIG. 5) of the three transmissions is supported by four portions P1, P2, P4 and P5 of the containing part. As is seen from FIG. 10, each transmission "T" comprises a torque converter part "TA", an automatic transmission part "TB" and an extension part "TC"

If desired, each case 1 may be provided at least one of the four side walls 10, 20, 30 and 40 with a mating mark. With this mark, the coupling and stacking of the cases 1 are much facilitated.

As will be understood from the foregoing description, in the present invention, the cases 1 for constituting one container are identical in shape. Thus, production and management of the containers are very facilitated as compared with the afore-mentioned conventional containers.

What is claimed is:

1. A container comprising:

first and second cases which are identical in shape, each of said cases having a front and a bottom wall constituting a back;

a first group of coupling portions possessed by each case, said first group of coupling portions establishing a coupling of said first and second cases when said first and second cases are mated in a front-to-front manner;

a second group of coupling portions possessed by each case, said second group of coupling portions establishing a coupling of said first and second cases when said first and second cases are mated in a back-to-back manner; and a third group of coupling portions possessed by each case, said third group of coupling portions establishing a coupling of said first and second cases when said first and second cases are mated in a front-to-back manner;

wherein said third group of coupling portions includes a plurality of hollow projections, formed as part of the bottom wall of each case, which project into an interior of said case and define a concave depression on an exterior face of said bottom wall, wherein said hollow projections of said first case are snugly received by the concave depressions in said second case when said first and second cases are mated front-to-back.

2. A container as claimed in claim 1, in which each of said first and second cases comprises four side walls and one generally rectangular bottom wall which are united to constitute a receptacle.

3. A container as claimed in claim 2, in which each case has a generally trapezoidal cross section so that one case can receive therein the other case in a front-to-back manner.

4. A container as claimed in claim 2, in which said first group of coupling portions comprise:

raised and recessed structures alternately formed on a front edge of each case, the raised and recessed structures of one case being engaged with the recessed and raised structures of the other case when the two cases are mated in a front-to-front manner;

means for defining holes in said front edge of each case; and studs formed on said front edge of each case, the studs of one case being received in the holes of the other case when the two cases are mated in a the front-to-front manner.

5. A container as claimed in claim 2, in which said second group of coupling portions comprise a plurality of coupling structures formed on given areas of an outer surface of said bottom wall of each case, the coupling structures of one case being engaged with the coupling structures of the other case when the two cases are mated in a back-to-back manner.

6. A container as claimed in claim 5, in which said coupling structures of each case are respectively formed on nine square areas on the outer surface of said bottom wall, the nine square areas being laid out at right angles.

7. A container as claimed in claim 6, in which seven of the nine coupling structures are of a two-projection type having two rectangular projections, and the remaining two of said coupling structures of a one-projection type having only one projection.

8. A container as claimed in claim 7, in which the two coupling structures of one-projection type are positioned at diagonally opposed corners of the bottom wall.

9. A container as claimed in claim 7, in which the two rectangular projections of each coupling structure of two-projection type are diagonally positioned in the corresponding square area.

10. A container as claimed in claim 2, in which said third group of coupling portions further comprise:

a plurality of external projections possessed by each case and positioned outside of each case, the external projections of one case being put on a front edge of the other case when the two cases are mated in a front-to-back manner; and internal projections possessed by each case and positioned inside of each case, said internal projections of one case supporting thereon the outer surface of the bottom wall of the other case when the two cases are mated in a front-to-back manner.

11. A container as claimed in claim 2, in which each of the first and second cases is of a two-layer structure comprising an inner structural member and an outer structural member which are partially welded to each other in a manner to define a certain space therebetween.

12. A container as claimed in claim 11, in which each case is shaped to contain therein three automotive automatic transmissions.

13. A transmission container comprising:

first and second cases which are identical in shape, each case including four side walls and one generally rectangular bottom wall which are united to constitute a receptacle having a front and a back;

raised and recessed structures alternately formed on a front edge of each case, the raised and recessed structures of one case being engaged with the recessed and raised structures of the other case when the two cases are mated in a front-to-front manner;

means for defining holes in said front edge of each case;

studs formed on said front edge of each case, the studs of one case being received in the holes of the other case when the two cases are mated in a front-to-front manner;

a plurality of coupling structures formed on given areas of an outer surface of said bottom wall of each case, the coupling structures of one case being engaged with the coupling structures of the other case when the two cases are mated in a back-to-back manner;

a plurality of external projections possessed by each case and positioned outside of each case, the external projections of one case being put on a front edge of the other case when the two cases are mated in a front-to-back manner;

a first group of internal projections possessed by each case and positioned inside of each case, the first group of internal projections of one case supporting thereon the outer surface of the bottom wall of the other case when the two cases are mated in a front-to-back manner; and a second group of internal projections which are possessed by each case, positioned inside of each case and formed hollow, the second group of internal projections of one case being partially received in a hollow portion of the second group of internal projections of the other case when the two cases are mated in a front-to-back manner.

14. A transmission container as claimed in claim 13, in which each of the first and second cases is of a two-layer structure comprising an inner structural member and an outer structural member which are partially welded to each other in a manner to define a certain space therebetween.

15. A transmission container as claimed in claim 14, in which said given areas of the coupling structures are possessed by said outer structural member.

16. A transmission container as claimed in claim 15, in which said given areas are protruded outward from said outer structural member, and in which the coupling structures on said given areas are protruded outward from said given areas.

17. A transmission container as claimed in claim 16, in which each case is shaped to contain three automotive automatic transmissions.

18. A transmission container as claimed in claim 13, in which each of said first and second cases has a generally trapezoidal cross section so that one case can receive therein the other case in a front-to-back mating manner.

* * * * *